US009216878B1

(12) United States Patent
Schunck

(10) Patent No.: US 9,216,878 B1
(45) Date of Patent: Dec. 22, 2015

(54) SPOOL SUPPORT SYSTEM

(71) Applicant: Robert John Schunck, St. Petersburg, FL (US)

(72) Inventor: Robert John Schunck, St. Petersburg, FL (US)

( * ) Notice: Subject to any disclaimer, the term of this patent is extended or adjusted under 35 U.S.C. 154(b) by 423 days.

(21) Appl. No.: 13/680,373

(22) Filed: Nov. 19, 2012

(51) Int. Cl.

| | |
|---|---|
| ***B65H 49/26*** | (2006.01) |
| ***B65H 49/32*** | (2006.01) |
| ***B65H 57/02*** | (2006.01) |
| ***B65H 57/08*** | (2006.01) |
| ***D05C 11/00*** | (2006.01) |
| ***D05B 81/00*** | (2006.01) |
| ***B65H 49/20*** | (2006.01) |
| ***B65H 57/26*** | (2006.01) |

(52) U.S. Cl.
CPC ..... *B65H 49/205* (2013.01); *B65H 49/26* (2013.01); *B65H 49/321* (2013.01); *B65H 49/325* (2013.01); *B65H 57/02* (2013.01); *B65H 57/08* (2013.01); *B65H 57/26* (2013.01); *D05B 81/00* (2013.01); *D05C 11/00* (2013.01); *B65H 2701/31* (2013.01)

(58) Field of Classification Search
CPC .... B65H 2701/31; B65H 49/06; B65H 49/32; B65H 2402/412; B65H 49/321; B65H 49/205; B65H 75/22; B65H 16/02; B65H 49/30; B65H 75/08; B65H 2701/374; B65H 2701/5122; B65H 49/26; B65H 49/305; B65H 75/141; B65H 16/005; B65H 49/325; B65H 57/02; B65H 57/08; B65H 57/26; D05B 81/00; D05C 11/00
See application file for complete search history.

(56) References Cited

U.S. PATENT DOCUMENTS

| | | | | |
|---|---|---|---|---|
| 113,858 | A * | 4/1871 | Cutler | 211/59.1 |
| 2,592,318 | A * | 4/1952 | Muecke | 242/129.7 |
| 2,633,310 | A * | 3/1953 | Eddy et al. | 242/141 |
| 3,381,641 | A * | 5/1968 | Bialy et al. | 112/302 |
| 7,325,766 | B1 * | 2/2008 | Schunck | 242/485.7 |
| 7,438,253 | B2 * | 10/2008 | Schunck | 242/566 |

* cited by examiner

*Primary Examiner* — William E Dondero

(57) ABSTRACT

A base has a central extent with a first leg and a second leg. A cylindrical rod is removably secured to the base at any of a plurality of locations. A cylindrical aperture in the first leg is adapted to receive and guide thread fed from a spool. Supplemental apertures are provided through the base adjacent to the first and second legs. A guide rod is fabricated of a relatively stiff material. The guide rod has a looped end and a short bent end. A friction member is provided at the base adjacent to the first leg frictionally supporting the short bent end of the guide rod for rotation between a stowed inoperative orientation and an extended operative orientation with the looped end remote from the second leg of the base.

1 Claim, 3 Drawing Sheets

FIG. 4
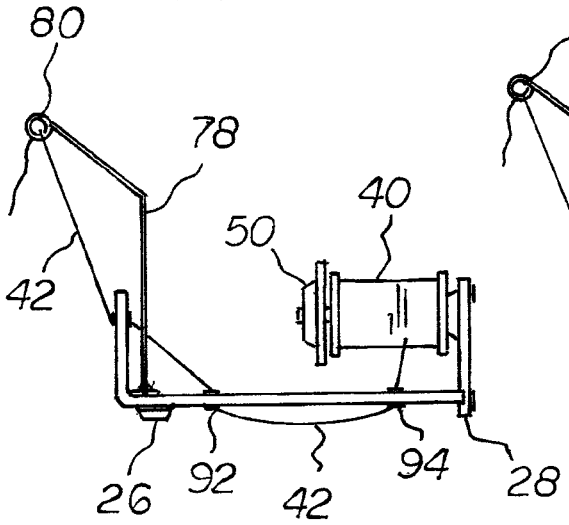
FIG. 5
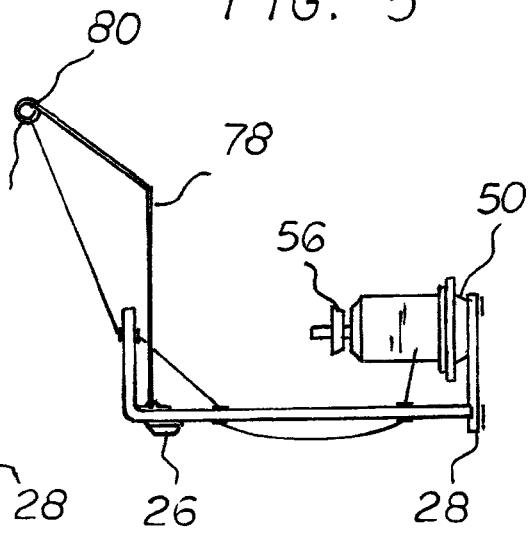
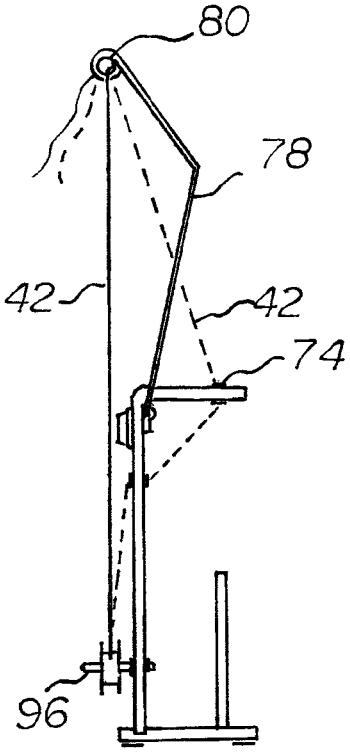
FIG 6
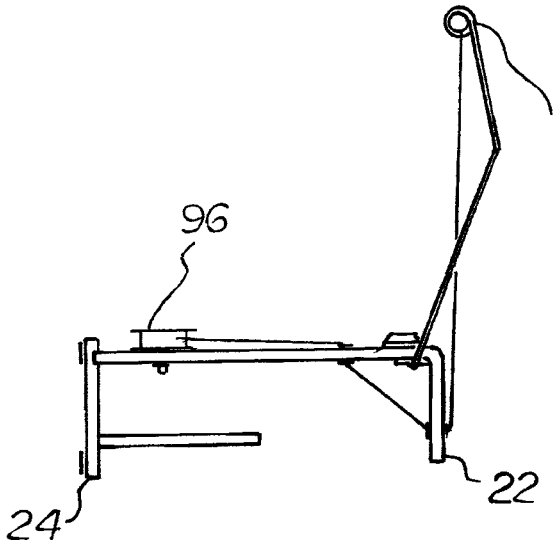
FIG. 7

FIG. 8
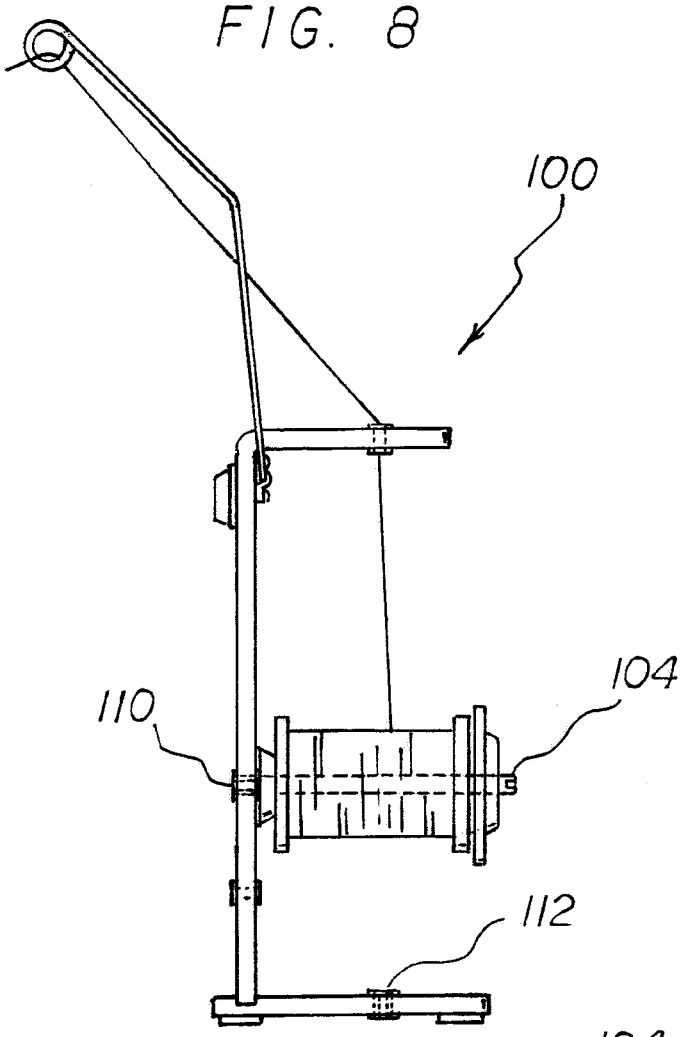
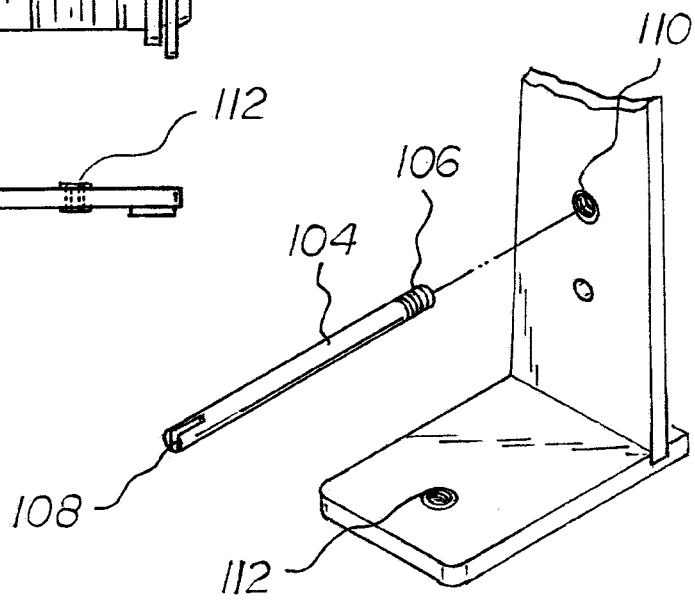
FIG. 9

SPOOL SUPPORT SYSTEM

BACKGROUND OF THE INVENTION

1. Field of the Invention

The present invention relates to a spool support system and more particularly pertains to feeding a thread from a repositionable spool to a sewing machine, the thread being threaded through the system as a function particular application.

2. Description of the Prior Art

The use of spool support systems of known designs and configurations is known in the prior art. More specifically, spool support systems of known designs and configurations previously devised and utilized for the purpose of supporting a spool through known methods and apparatuses are known to consist basically of familiar, expected, and obvious structural configurations, notwithstanding the myriad of designs encompassed by the crowded prior art which has been developed for the fulfillment of countless objectives and requirements.

By way of example, By way of example, U.S. Pat. No. 3,309,040 issued Mar. 14, 1967 to Stancil relates to a Reversible Spool Unit for Knitting Yarn. U.S. Pat. No. 5,285,740 issued Feb. 15, 1994 to Yanagi relates to a Horizontal Spool Pin Supporting Device for a Sewing Machine. U.S. Pat. No. 5,913,485 issued Jan. 22, 1999 to Buffett relates to a Device for Holding a Plurality of Spools of Thread and Feeding a Selected Thread onto an Adjacent Sewing Machine. Lastly, U.S. Pat. No. 7,438,253 issued Oct. 21, 2008 to Schunck relates to a Spool Support System.

While these devices fulfill their respective, particular objectives and requirements, the aforementioned patents do not describe a spool support system that allows for feeding a thread from a spool to a sewing machine, the thread being threaded through at least one aperture in the system as a function particular application.

In this respect, the spool support system according to the present invention substantially departs from the conventional concepts and designs of the prior art, and in doing so provides an apparatus primarily developed for the purpose of feeding a thread from a spool to a sewing machine, the thread being threaded through at least one aperture in the system as a function particular application.

Therefore, it can be appreciated that there exists a continuing need for a new and improved spool support system which can be used for feeding a thread from a spool to a sewing machine, the thread being threaded through at least one aperture in the system as a function particular application. In this regard, the present invention substantially fulfills this need.

SUMMARY OF THE INVENTION

In view of the foregoing disadvantages inherent in the known types of spool support systems of known designs and configurations now present in the prior art, the present invention provides an improved spool support system. As such, the general purpose of the present invention, which will be described subsequently in greater detail, is to provide a new and improved spool support system and method which has all the advantages of the prior art and none of the disadvantages.

To attain this, the present invention essentially comprises a spool support system. First provided is a base. The base includes a central extent with a first leg and a second leg. A cylindrical rod is removably secured to the base at any of a plurality of locations. A cylindrical aperture in the first leg is adapted to receive and guide thread fed from a spool. Supplemental apertures are provided through the base adjacent to the first and second legs. A guide rod is fabricated of a relatively stiff material. The guide rod has a looped end and a short bent end. A friction member is provided at the base adjacent to the first leg frictionally supporting the short bent end of the guide rod for rotation between a stowed inoperative orientation and an extended operative orientation with the looped end remote from the second leg of the base.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved spool support system which has all of the advantages of the prior art spool support systems of known designs and configurations and none of the disadvantages.

It is another object of the present invention to provide a new and improved spool support system which may be easily and efficiently manufactured and marketed.

It is further object of the present invention to provide a new and improved spool support system which is of durable and reliable constructions.

An even further object of the present invention is to provide a new and improved spool support system which is susceptible of a low cost of manufacture with regard to both materials and labor, and which accordingly is then susceptible of low prices of sale to the consuming public, thereby making such spool support system economically available to the buying public.

Even still another object of the present invention is to provide a spool support system for feeding a thread from a spool to a sewing machine, the thread being threaded through at least one aperture in the system as a function particular application.

Lastly, it is an object of the present invention to provide a new and improved spool support system for feeding a thread from a repositionable spool to a sewing machine, the thread being threaded through at least one aperture in the system as a function particular application, the feeding and threading being done in a safe, convenient and economical manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a front elevational view similar to FIG. 1 but with the rod and spool horizontally disposed.

FIG. 5 is a front elevational view of a spool support system similar to FIG. 4 but utilizing an alternate spool.

FIG. 6 is a front elevational view of a spool support system similar to FIG. 4 but with the rod vertically disposed and utilizing a horizontal bobbin as an alternate spool.

FIG. 7 is a front elevational view of a spool support system similar to FIG. 6 but with the rod horizontally disposed and utilizing an upstanding vertical bobbin as an alternate spool.

FIGS. 8 and 9 are a front elevational view and a side elevational view of a final alternate embodiment of the invention.

The same reference numerals refer to the same parts throughout the various Figures.

DESCRIPTION OF THE PREFERRED EMBODIMENT

Figure 1:
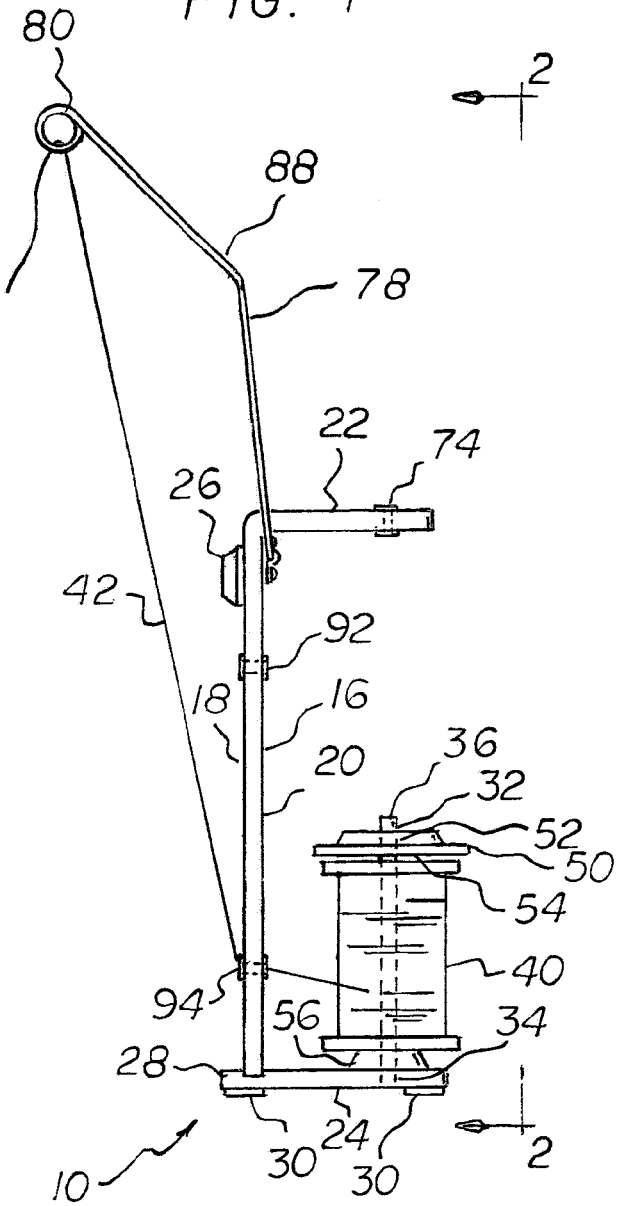
FIG. 1 is a front elevational view of a spool support system constructed in accordance with the primary embodiment of the present invention, the system being deployed for operation and use with the rod and spool vertically disposed.
Figure 2:
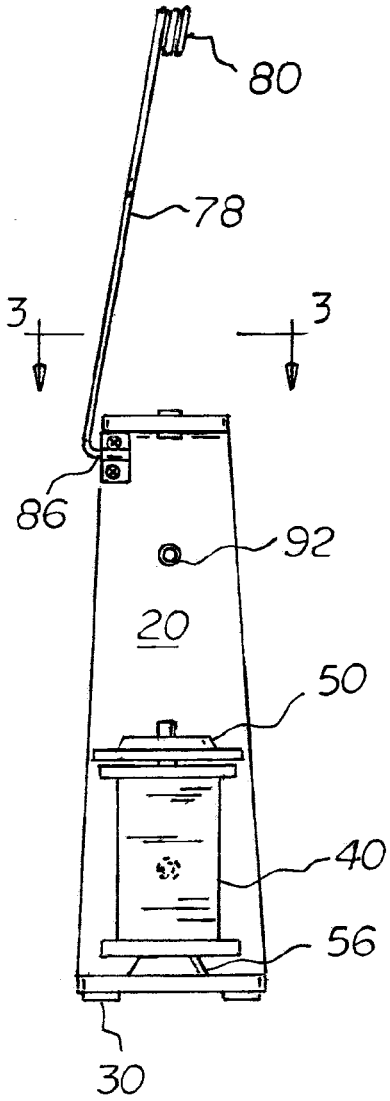
FIG. 2 is an end elevational view of the system taken along line 2-2 of FIG. 1.
Figure 3:
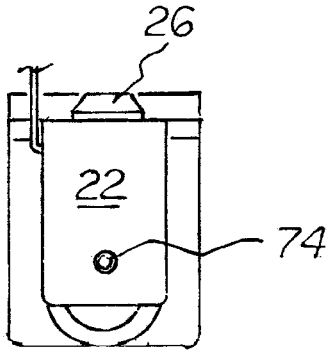
FIG. 3 is a plan view of the system taken long line 3-3 of FIG. 2.

With reference now to the drawings, and in particular to FIG. 1 thereof, the preferred embodiment of the new and improved spool support system embodying the principles and concepts of the present invention and generally designated by the reference numeral 10 will be described.

The present invention, the spool support system 10 is comprised of a plurality of components. Such components in their broadest context include a base, a cylindrical rod, a cylindrical aperture and a guide rod. Such components are individually configured and correlated with respect to each other so as to attain the desired objective.

First provided is a base 14. The base is in a generally U-shaped configuration. The base includes a central extent 16. The central extent has a planar exterior face 18. The central extent has a parallel interior face 20. The interior face has a first end. The first end has a first leg 22. The first leg extends perpendicularly from the first. The interior face has a second end. The second end has a second leg 24. The second end extends perpendicularly from the second end. In this manner the system is supported. The base also includes a first spacer 26. The first spacer is secured to the exterior face adjacent to the first end. The base also includes a second spacer 28. The second spacer extends from the exterior face adjacent to the second end. In this manner the system is supported. The base is fabricated of a rigid plastic material.

A cylindrical rod 32 is provided. The rod has a fixed end 34. The fixed end is rigidly secured to the second leg. The rod has a free end 36. The free end faces toward the first leg. The rod is parallel with the interior face of the central extent. The rod is fabricated of a rigid metal. The rod has a length of between about 40 and 60 percent of the length of the central extent.

A generally cylindrical spool 40 is provided. The spool has an interior cylindrical surface. The interior surface is rotatably received on the rod. The rod has an exterior cylindrical surface. Thread is supported on the exterior surface. The spool includes free axial ends. The spool has an interior flange 44. The spool also has an exterior flange 46. The flanges are provided at the free axial ends of the spool.

Spool retention components are provided next. The spool retention components include a stepped disk 50. The stepped disk is fabricated of a lubricious plastic material. The stepped disk has a central aperture 52. The central aperture is adapted to be frictionally supported on the rod. The disk has a stepped interior end 54. The stepped interior end is adapted to receive the exterior flange of the spool. In this manner a friction abating surface is provided for thread pulled from the spool during operation and use. A spacer 56 is provided. The spacer supports the spool.

Further provided is a cylindrical aperture 74. The cylindrical aperture is provided in the first leg. The cylindrical aperture is axially aligned with the rod. Thread 42 is provided. The cylindrical aperture is adapted to receive and guide thread fed to a sewing machine from a spool.

Provided last is a guide rod 78. The guide rod is fabricated of a relatively stiff metal wire. The guide rod has a looped end 80. The guide rod has a short bent end. The guide rod has an extended length 88. The extended length is provided between the looped end and the short bent end. A friction plate 86 is provided. The friction plate extends laterally into the base in proximity to the central extent and the first leg. The short recess frictionally supports the short bent end of the guide rod for rotation between a stowed inoperative orientation and an extended operative orientation. In the stowed inoperative orientation, the looped end is positioned in proximity to the second leg. In the extended operative orientation, the looped end is positioned remote from the central extent and second leg of the base. An upper supplemental aperture 92 is provided. The upper supplemental aperture extends through the base plate adjacent to the first leg. A lower supplemental aperture 94 is provided. The lower supplemental aperture extends through the base plate adjacent to the second leg. The looped end receives and guides a thread from the aperture in the first leg. The extended length has a bend in a central extent between about 120 and 150 degrees. In this manner the system is operable when in a primary mode, a first alternate mode and a second alternate mode. In the primary mode, the exterior face of the base is positioned on a recipient surface. In the first alternate mode, the second leg is positioned on a recipient surface. In the second alternative mode, the exterior face of the base is spaced above and parallel with a recipient surface. A stub 96 is provided. The stub is adapted to be secured from the lower supplemental aperture. In this manner a bobbin is supported when in the primary mode and when in the second alternate mode.

A final alternate embodiment of the invention is illustrated in FIGS. 8 and 9. Such embodiment is a system 100 which features a selectively repositionable rod 104. The repositionable rod includes an interior threaded end 106. The repositionable rod includes an exterior free end with a slot 108. In order to selectively receive the threaded end of the rod, the base is formed to include a plurality of threaded aperture 110, 112 adapted to removably receive the threaded aperture 110 in the second leg of the base. This provides a configuration as described above. The threaded apertures also include a second threaded aperture 112 in the second leg of the base. This provides a configuration with extended benefits since the thread will be pulled from the spool tangentially while the thread will leave the system at an elevation above the sewing machine it is feeding. The slot in the free end of the rod is sized to receive a coin to facilitate twisting and rotating the rod with the base when coupling and uncoupling.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A spool support system (100) for feeding a thread from a repositionable spool to a sewing machine, the thread being threaded through at least one aperture in the system as a function particular application, the feeding and threading being done in a safe, convenient and economical manner, the system comprising, in combination:

a base (14) in a generally U-shaped configuration including a central extent (16) with a planar exterior face (18) and a parallel interior face, the interior face (20) having a first end with a first leg (22) extending perpendicularly from the first end and a second end with a second leg (24) extending perpendicularly from the second end for supporting the system, the base also including a first spacer (26) secured to the exterior face adjacent to the first end and a second spacer (28) extending from the exterior face adjacent to the second end for supporting the system, the base being fabricated of a rigid plastic material;

a selectively repositionable rod (104) including an interior threaded end (106) and an exterior free end with a slot (108), the base being formed to include a plurality of threaded apertures adapted to removably and selectively receive the threaded end of the rod, the threaded apertures including a first threaded aperture (110) in the second leg of the base, the threaded apertures including a second threaded aperture (112) in the central extent of the base;

a generally cylindrical spool (40) with an interior cylindrical surface rotatably received on the rod and an exterior cylindrical surface supporting thread thereon, the spool including free axial ends with an interior flange (44) and an exterior flange (46) at the free axial ends thereof;

spool retention components including a stepped disk (50) fabricated of a lubricious plastic material with a central aperture (52) adapted to be frictionally supported on the rod and with the disk having a stepped interior end (54) adapted to receive the exterior flange of the spool for providing a friction abating surface for thread pulled from the spool during operation and use, a spacer (56) supporting the spool;

a cylindrical aperture (74) in the first leg axially aligned with the rod and adapted to receive and guide thread (42) fed to a sewing machine from a spool; and a guide rod (78) fabricated of a relatively stiff metal wire, the guide rod having a looped end (80) and a short bent end and an extended length (88) there between, with a friction plate (86) extending laterally into the base in proximity to the central extent and the first leg, short recess frictionally supporting the short bent end of the guide rod for rotation between a stowed inoperative orientation with the looped end in proximity to the second leg and an extended operative orientation with the looped end remote from the central extent and second leg of the base, an upper supplemental aperture (92) extending through the base plate adjacent to the first leg, a lower supplemental aperture (94) extending through the base plate adjacent to the second leg, the looped end receiving and guiding a thread from the aperture in the first leg, the extended length having a bend in a central extent of between about 120 and 150 degrees whereby the system is operable when in a primary mode with the exterior face of the base on a recipient surface and in a first alternate mode with the second leg on a recipient surface and a second alternative mode with the exterior face of the base spaced above and parallel with a recipient surface, a stub (96) adapted to be secured from the lower supplemental aperture for supporting a bobbin when in the primary mode and when in the second alternate mode.

* * * * *